US009475560B1

(12) United States Patent
Jaszewski et al.

(10) Patent No.: US 9,475,560 B1
(45) Date of Patent: Oct. 25, 2016

(54) OUTBOARD MOTOR AND MIDSECTION ASSEMBLY FOR OUTBOARD MOTOR

(71) Applicant: Brunswick Corporation, Lake Forest, IL (US)

(72) Inventors: Wayne M. Jaszewski, Jackson, WI (US); Randall J. Poirier, Fond du Lac, WI (US); Andrew Tuchscherer, Wauwatosa, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 14/639,413

(22) Filed: Mar. 5, 2015

(51) Int. Cl.

| | |
|---|---|
| ***B63H 5/20*** | (2006.01) |
| ***B63H 20/00*** | (2006.01) |
| ***B63H 20/32*** | (2006.01) |
| ***B63H 20/12*** | (2006.01) |
| ***B63H 20/24*** | (2006.01) |
| ***B63H 20/02*** | (2006.01) |
| ***B63H 20/10*** | (2006.01) |

(52) U.S. Cl.
CPC ..... *B63H 20/002* (2013.01); *B63H 20/02* (2013.01); *B63H 20/10* (2013.01); *B63H 20/12* (2013.01); *B63H 20/24* (2013.01); *B63H 20/32* (2013.01)

(58) Field of Classification Search
CPC .... B63H 20/002; B63H 20/02; B63H 20/10; B63H 20/12; B63H 20/20; B63H 20/32
USPC ..... 440/53, 61 S
See application file for complete search history.

(56) References Cited

U.S. PATENT DOCUMENTS 3,285,221 A * 11/1966 North ..... B63H 20/10 440/52
3,310,021 A * 3/1967 Shimanckas ..... B63H 20/12 440/52
3,376,842 A * 4/1968 Wynne ..... B63H 20/002 440/112

(Continued)

FOREIGN PATENT DOCUMENTS

CA 1317165 C 5/1993

OTHER PUBLICATIONS

Murray, Charles J., Boat Drive Increases Usable Onboard Space: Outboard motor is mounted inboard, reprinted from Design News, Mar. 1989, United States.

*Primary Examiner* — Stephen Avila

(57) ABSTRACT

An outboard motor includes an internal combustion engine, and an adapter plate having an upper end that supports the engine and a lower end formed as a cylindrical neck. A driveshaft housing below the adapter plate has an integral oil sump collecting oil that drains from the engine and through the adapter plate neck. One or more bearings couple the adapter plate neck to the oil sump such that the driveshaft housing is suspended from and rotatable with respect to the adapter plate. A driveshaft is coupled to a crankshaft of the engine, and extends along a driveshaft axis through the adapter plate neck, bearing(s), and oil sump. A steering actuator is coupled to and rotates the oil sump, and thus the driveshaft housing, around the driveshaft axis with respect to the adapter plate, which varies a direction of the outboard motor's thrust.

20 Claims, 7 Drawing Sheets

(56) References Cited

U.S. PATENT DOCUMENTS

| | | | | |
|---|---|---|---|---|
| 3,707,939 | A * | 1/1973 | Berg | B63H 5/125 440/58 |
| 3,930,436 | A * | 1/1976 | Hedenberg | B62D 5/22 91/216 A |
| 4,907,994 | A | 3/1990 | Jones | |
| 4,911,666 | A | 3/1990 | Gage et al. | |
| 5,108,325 | A | 4/1992 | Livingston et al. | |
| 5,224,888 | A | 7/1993 | Fujimoto et al. | |
| 5,487,687 | A | 1/1996 | Idzikowski et al. | |
| 6,146,220 | A | 11/2000 | Alby et al. | |
| 6,183,321 | B1 | 2/2001 | Alby et al. | |
| 6,402,577 | B1 | 6/2002 | Treinen et al. | |
| 7,387,556 | B1 | 6/2008 | Davis | |
| 8,246,398 | B2 | 8/2012 | Inaba | |
| 8,485,854 | B2 | 7/2013 | Gallato et al. | |
| 8,651,904 | B2 | 2/2014 | Pellegrinetti et al. | |
| 8,690,616 | B2 | 4/2014 | Grassi et al. | |
| 8,808,045 | B2 * | 8/2014 | Lundqvist | B63H 21/32 440/89 A |
| 2007/0004294 | A1 * | 1/2007 | Mansfield | B63H 20/02 440/86 |

* cited by examiner

OUTBOARD MOTOR AND MIDSECTION ASSEMBLY FOR OUTBOARD MOTOR

FIELD

The present disclosure relates to outboard motors and midsection assemblies for outboard motors, which are configured to be mounted to a transom of a marine vessel via a transom mounting system.

BACKGROUND

U.S. Pat. No. 5,487,687, which is incorporated herein by reference, discloses an outboard marine drive having a midsection between the upper power head and the lower gear case and having a removable midsection cowl assembly including first and second cowl sections. The midsection housing includes an oil sump in one embodiment and further includes an exhaust passage partially encircled by cooling water and partially encircled by engine oil for muffling engine exhaust noise. The midsection housing also has an oil drain arrangement providing complete and clean oil draining while the outboard drive is mounted on a boat and in the water.

U.S. Pat. No. 6,183,321, which is incorporated herein by reference, discloses an outboard motor having a pedestal that is attached to a transom of a boat, a motor support platform that is attached to the outboard motor, and a steering mechanism that is attached to both the pedestal and the motor support platform. A hydraulic tilting mechanism is attached to the motor support platform and to the outboard motor. The outboard motor is rotatable about a tilt axis relative to both the pedestal and the motor support platform. A hydraulic pump is connected in fluid communication with the hydraulic tilting mechanism to provide pressurized fluid to cause the outboard motor to rotate about its tilting axis. An electric motor is connected in torque transmitting relation with the hydraulic pump. Both the electric motor and the hydraulic pump are disposed within the steering mechanism.

U.S. Pat. No. 6,402,577, which is incorporated herein by reference, discloses a hydraulic steering system in which a steering actuator is an integral portion of the support structure of a marine propulsion system. A steering arm is contained completely within the support structure of the marine propulsion system and disposed about its steering axis. An extension of the steering arm extends into a sliding joint which has a linear component and a rotational component which allow the extension of the steering arm to move relative to a moveable second portion of the steering actuator. The moveable second portion of the steering actuator moves linearly within a cylinder cavity formed in a first portion of the steering actuator.

U.S. Pat. No. 7,244,152, which is incorporated herein by reference, discloses an adapter system provided as a transition structure which allows a relatively conventional outboard motor to be mounted to a pedestal which provides a generally stationary vertical steering axis. An intermediate member is connectable to a transom mount structure having a connector adapted for mounts with central axes generally perpendicular to a plane of symmetry of the marine vessel. Many types of outboard motors have mounts that are generally perpendicular to this configuration. The intermediate member provides a suitable transition structure which accommodates both of these configurations and allows the conventionally mounted outboard motor to be supported, steered, and tilted by a transom mount structure having the stationary vertical steering axis and pedestal-type configuration.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In a first example of the present disclosure, an outboard motor comprises an internal combustion engine, and an adapter plate having an upper end that is coupled to and supports the engine and a lower end formed as a cylindrical neck. A driveshaft housing is situated below the adapter plate and has an integral oil sump collecting oil that drains from the engine and through the adapter plate neck. The oil sump has a cylindrical upper end. A first bearing couples the adapter plate neck to the upper end of the oil sump such that the driveshaft housing is suspended from and rotatable with respect to the adapter plate. A driveshaft has an upper end coupled to a crankshaft of the engine, and extends along a driveshaft axis through the adapter plate neck, the first bearing, and the oil sump toward a lower end. A steering actuator is coupled to and configured to rotate the oil sump so as to rotate the driveshaft housing around the driveshaft axis with respect to the adapter plate and thereby vary a direction of thrust produced by the outboard motor.

According to another example of the present disclosure, a midsection assembly for an outboard motor includes an adapter plate having an upper end configured to support an internal combustion engine and a lower end formed as a cylindrical neck, and a driveshaft housing situated below the adapter plate and having an integral oil sump collecting oil that drains from the engine and through the adapter plate neck. The oil sump has a cylindrical upper end. A steering arm extends from the upper end of the oil sump. A first bearing couples the adapter plate neck to the upper end of the oil sump such that the driveshaft housing is suspended from and rotatable with respect to the adapter plate. A generally vertical driveshaft axis is defined through the adapter plate neck, the first bearing, and the oil sump. The steering arm is configured to be coupled to a steering actuator such that the oil sump and the driveshaft housing can be actuated to rotate around the driveshaft axis with respect to the adapter plate so as to vary a direction of thrust produced by the outboard motor.

BRIEF DESCRIPTION OF THE DRAWINGS

The present disclosure is described with reference to the following Figures. The same numbers are used throughout the Figures to reference like features and like components.

DETAILED DESCRIPTION

In the present description, certain terms have been used for brevity, clarity, and understanding. No unnecessary limitations are to be inferred therefrom beyond the requirement of the prior art because such terms are used for descriptive purposes only and are intended to be broadly construed.

Figure 2:
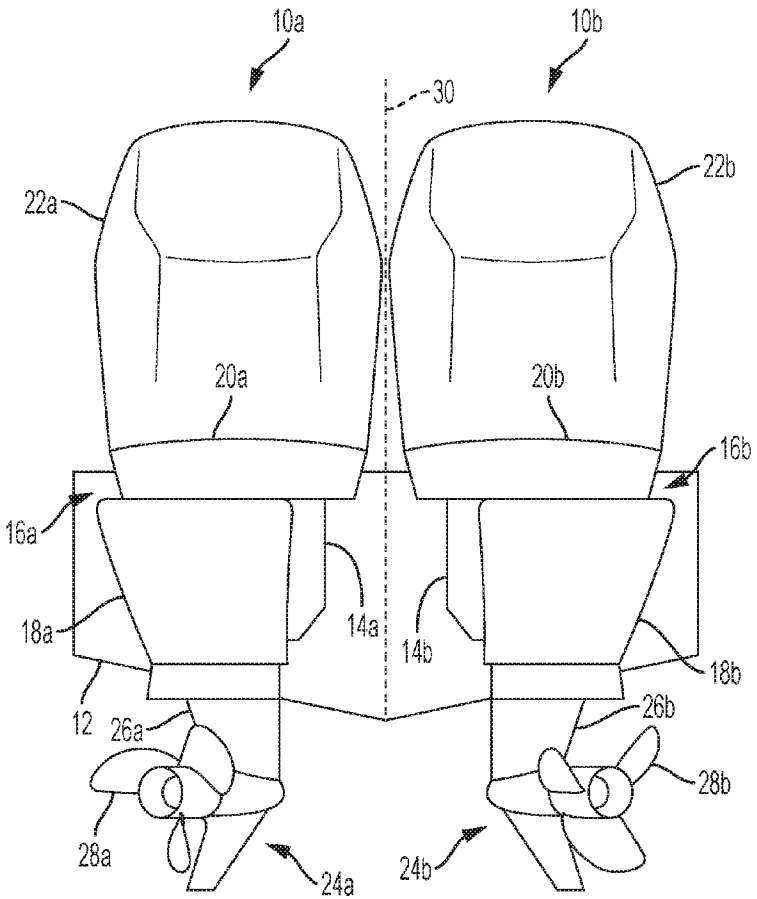
FIG. 2 illustrates a pair of outboard motors, wherein the midsection housing of each outboard motor is rotated outwardly.
Figure 1:
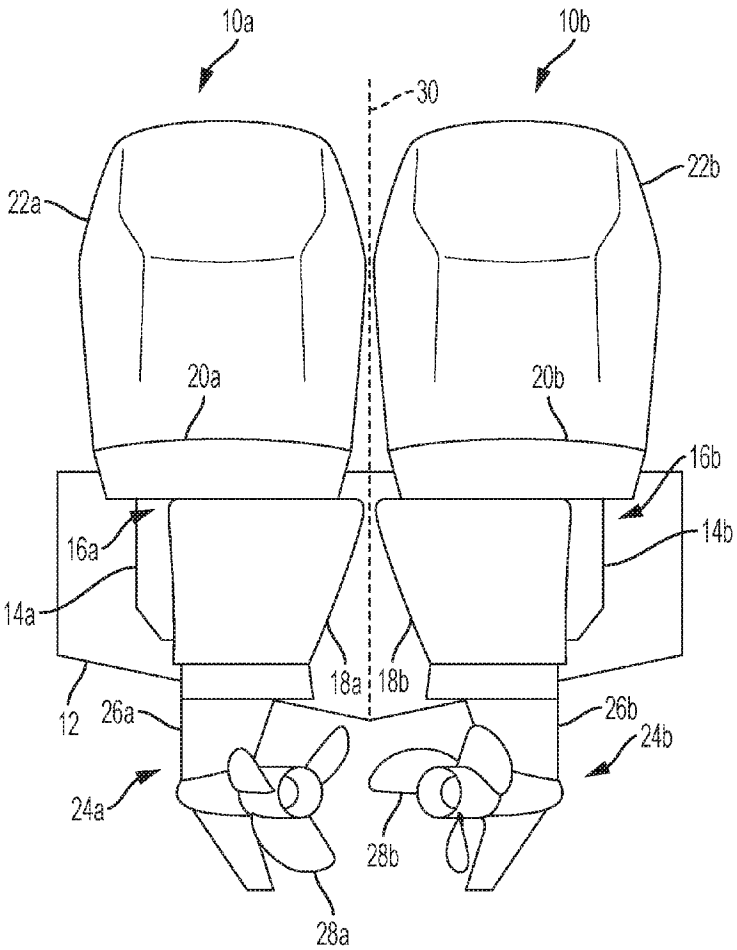
FIG. 1 illustrates a pair of outboard motors, wherein a midsection housing of each outboard motor is rotated inwardly.
Figure 3:
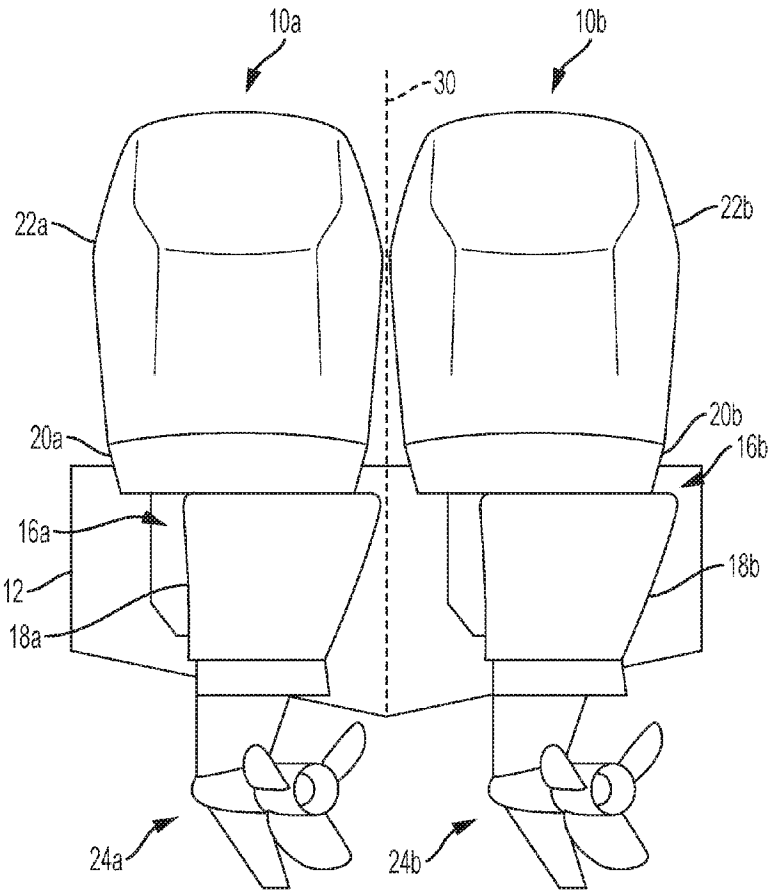
FIG. 3 illustrates a pair of outboard motors, wherein the midsection assembly of each outboard motor is rotated toward starboard.

FIGS. 1-3 illustrate various positions of outboard motors with respect to a transom of a marine vessel to which they are coupled. In FIG. 1, a port outboard motor 10*a* and a starboard outboard motor 10*b* are coupled to a transom 12 of a marine vessel. More specifically, the outboard motors 10*a*, 10*b* are coupled to the transom 12 by way of pedestals (transom brackets) 14*a*, 14*b*. The pedestals 14*a*, 14*b* are attached to the transom 12 such as by way of bolts or other mounting devices extending through the pedestal 14*a*, 14*b* and into the transom 12. One example of such attachment is described in U.S. Pat. No. 6,183,321, which was incorporated by reference above, and will therefore not be described further herein, it being understood that there are other ways to couple a transom bracket to a transom than that shown in the '321 patent. The pedestals 14*a*, 14*b* are in turn coupled to midsection assemblies 16*a*, 16*b* of the outboard motors 10*a*, 10*b*, which midsection assemblies 16*a*, 16*b* include driveshaft housings 18*a*, 18*b* and cradles 20*a*, 20*b*. More details of how the pedestals 14*a*, 14*b* are coupled to the midsection assemblies 16*a*, 16*b* will be described further herein below. Powerheads 22*a*, 22*b*, which include internal combustion engines for powering the outboard motors 10*a*, 10*b*, are situated above the cradles 20*a*, 20*b*. Lower units 24*a*, 24*b*, including gearcases 26*a*, 26*b* and propellers 28*a*, 28*b*, are situated below the driveshaft housings 18*a*, 18*b*.

Generally, in order to vary a direction of thrust produced by an outboard motor so as to change a marine vessel's direction, the entire outboard motor is rotated around a generally vertical steering axis by a steering assembly located on or near the pedestal. For one example of such a configuration, see U.S. Pat. No. 6,402,577, which was incorporated by reference above. Additionally, an outboard motor is able to be tilted or trimmed about generally horizontal tilt/trim axis, for example as disclosed in U.S. Pat. No. 6,183,321, which was also incorporated by reference above, in order to direct the thrust produced by the outboard motor more upwardly or more downwardly and thereby vary the attitude of the marine vessel in the water. The present inventors have realized that as consumers have required more power from their outboard motors, outboard motors have in turn become bigger, especially in the powerhead section in order to accommodate an engine that is large enough to meet consumers' power needs. Having a large powerhead increases the cowl size of the outboard motors, and especially when the outboard motors are turning, or tilting and turning at the same time, the cowls of large outboard motors may contact one another. For example, when an operator of a marine vessel uses a steering wheel (or similar helm input device) to rotate two or more outboard motors around their vertical steering axes in one direction or another, this could cause the outboard motors to collide. Interference may also occur when the outboard motors are tilted or trimmed about their horizontal tilt/trim axes. When two or more outboard motors are both rotated around their vertical steering axes and tilted/trimmed, the interference is magnified.

Some consumers, when repowering a marine vessel (i.e., putting a new outboard motor on a used marine vessel), wish to reuse holes that have already been drilled in the transom 12 of the marine vessel for attachment of the new outboard motors. On existing marine vessels, a distance between the centerlines of these already-drilled holes is generally about 26 inches, which may not provide enough room to accommodate turning, tilting, and trimming movements of larger outboard motors requested by today's consumers. Additionally, some consumers wish to install four, five, or more outboard motors on a single marine vessel transom 12. Marine vessels are generally limited in overall width for a number of reasons, and fitting this many outboard motors, especially when their powerheads are larger due to requests for greater power, can be difficult. Other applications where outboard motors have the potential to interfere with one another are when less than 26-inch centerline mountings are requested, or when v-shaped outboard motors (especially in the 200-plus horsepower range) are used, because v-shaped engines are significantly wider than inline engines. Additionally, it would be desirable to be able to mount smaller engines (such as inline 6-cylinder engines) on centerlines that are less than 26 inches from one another, such as for example at 23.5-inch centerlines.

All of the above-mentioned examples and observations have led the present inventors to develop an outboard motor in which the midsection assembly 16*a*, 16*b* can be rotated with respect to the powerhead 22*a*, 22*b*, thereby avoiding problems associated with rotating the entire outboard motor 10*a*, 10*b*, including a potentially very large powerhead 22*a*, 22*b*, around a vertical steering axis. By maintaining the powerhead 22*a*, 22*b* stationary (or at least limiting its rotation around a vertical steering axis to a particular angle), interference during tilt/trim and turning maneuvers can be minimized and in some cases even prevented altogether. Additionally, by rotating only the midsection assemblies 16*a*, 16*b* and lower units 24*a*, 24*b* associated therewith, it is possible to achieve tighter steering angles than if the entire outboard motor 10*a*, 10*b* were to be rotated around a vertical steering axis. Even in the case where the powerhead 22*a*, 22*b* is able to be rotated, such rotation can be limited based on the size of the outboard motor, and additional rotation of the midsection assembly 16*a*, 16*b* with respect to the powerhead 22*a*, 22*b* can achieve tighter turns than previously possible with the same size of outboard motor.

In FIG. 1, it can be seen that the midsection assemblies 16*a*, 16*b* of outboard motors 10*a*, 10*b* are both rotated inwardly, such that propellers 28*a*, 28*b* produce thrust that is directed toward a virtual centerline 30 of the marine vessel. More specifically, the driveshaft housings 18*a*, 18*b* of each outboard motor 10*a*, 10*b* are rotated with respect to the cradles 20*a*, 20*b* and powerheads 22*a*, 22*b*, the latter two of which remain stationary and parallel to the centerline 30 of the marine vessel. If each entire outboard motor 10*a*, 10*b* were instead rotated in an attempt to achieve these same angles of thrust, it can be seen that the aft-most portions of the powerheads 22*a*, 22*b* would likely collide.

By way of further example, in FIG. 2, each of the midsection assemblies 16*a*, 16*b* are rotated outwardly, such that their thrusts are directed away from the centerline 30 of the marine vessel. More specifically, both of the driveshaft housings 18*a*, 18*b* are rotated outwardly with respect to the cradles 20*a*, 20*b* and powerheads 22*a*, 22*b*, the latter two of which remain stationary and oriented parallel with respect to the centerline 30. If each entire outboard motor 10*a*, 10*b* were instead rotated in an attempt to achieve these same angles of thrust, it can be seen that the fore-most portions of the powerheads 22*a*, 22*b* would likely collide.

In FIG. 3, both of the midsection assemblies 16*a*, 16*b* are rotated to starboard, such that the outboard motors 10*a*, 10*b* produce forward thrusts on the rear of the vessel in a port direction, which would cause the marine vessel to turn toward starboard. More specifically, the driveshaft housings 18*a*, 18*b* are both rotated to starboard with respect to the cradles 20*a*, 20*b* and powerheads 22*a*, 22*b*, the latter two of which remain stationary with respect to the centerline 30. In this instance, if each entire outboard motor 10*a*, 10*b* were instead rotated in an attempt to achieve these same angles of thrust, and especially if one or both of the outboard motors 10*a*, 10*b* were tilted/trimmed as it was rotated, the powerheads 22*a*, 22*b* would likely collide.

Figure 4:
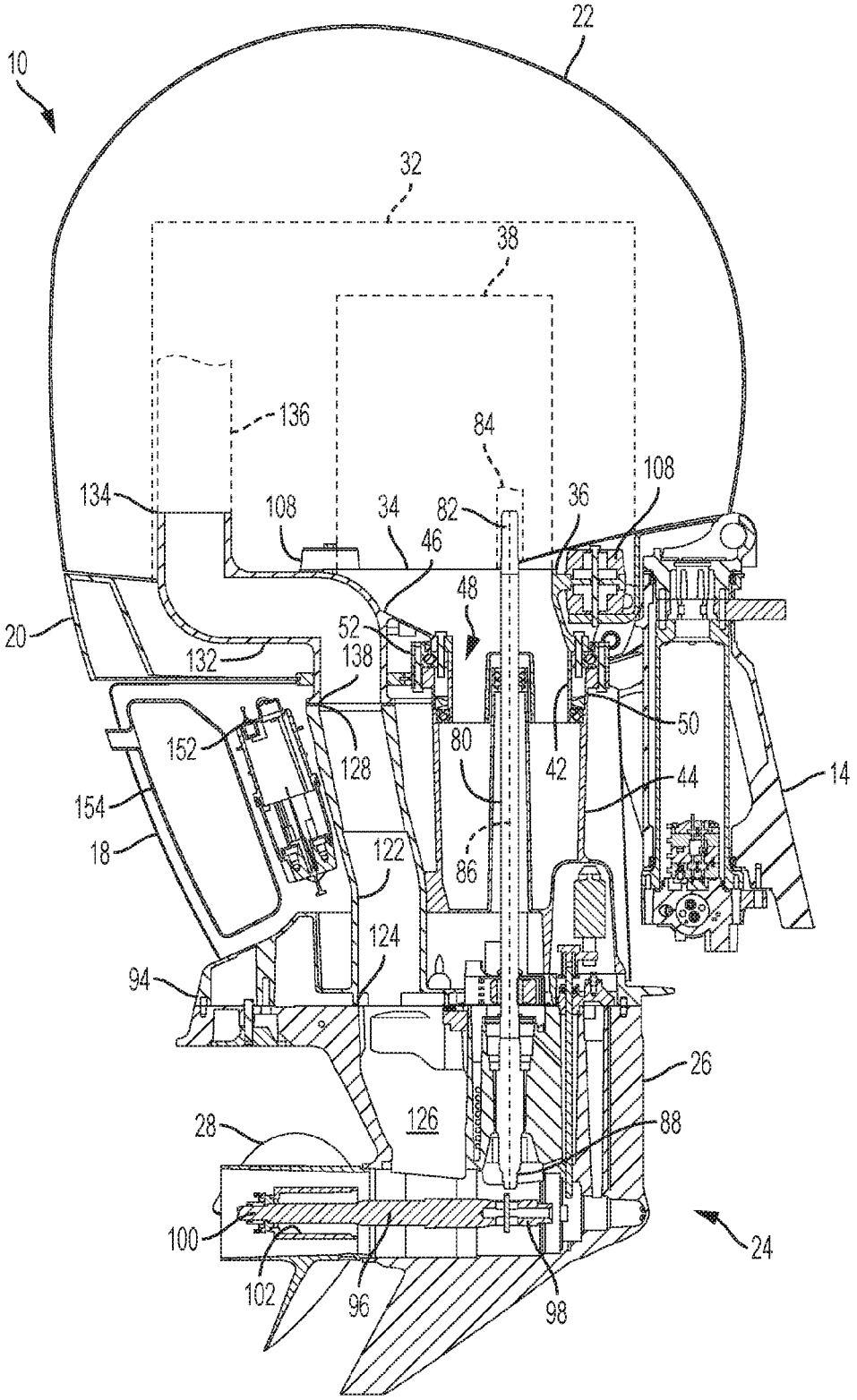
FIG. 4 illustrates a partial cross-sectional view of an outboard motor according the present disclosure.
Figure 7:
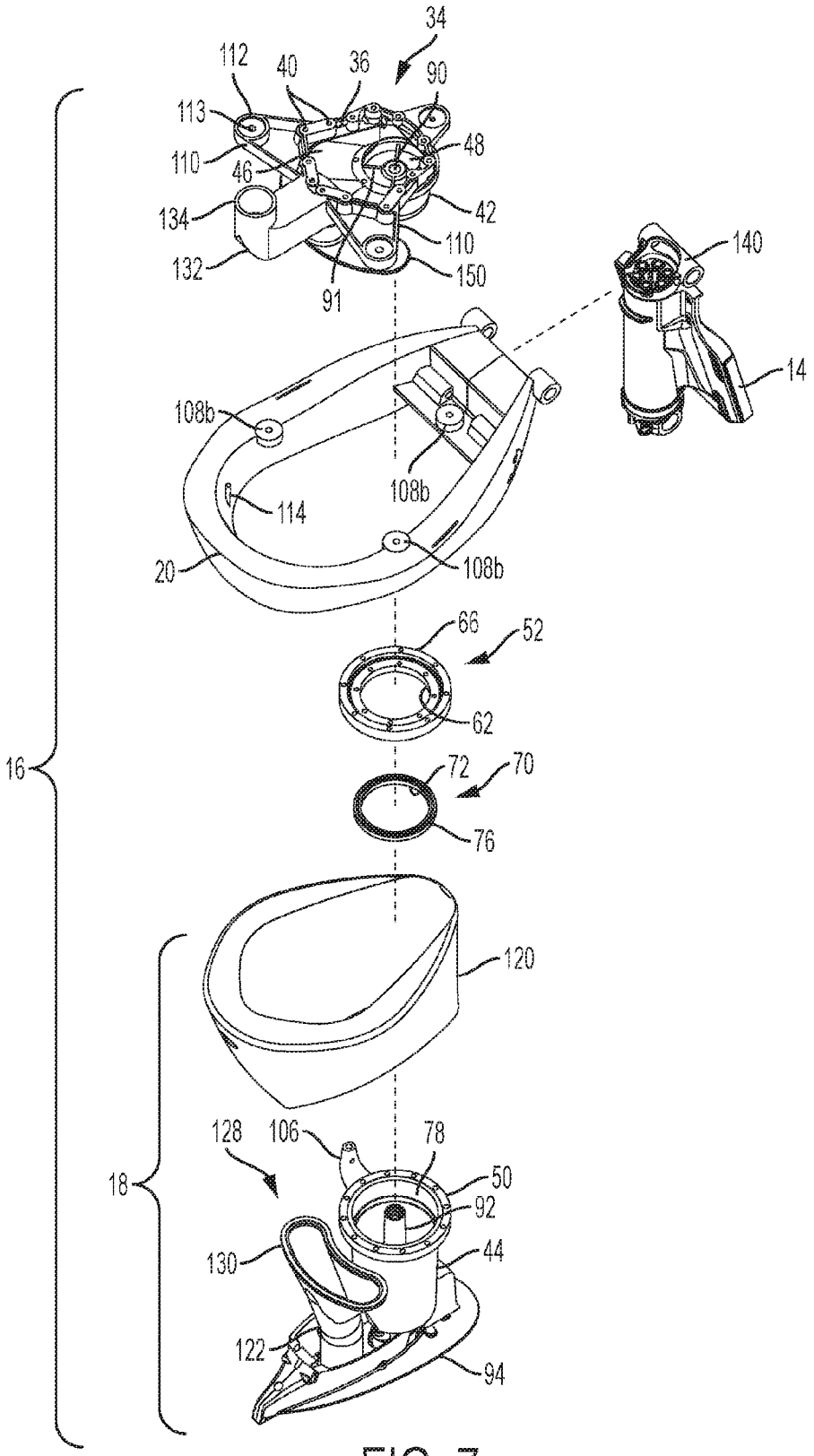
FIG. 7 illustrates an exploded view of the midsection assembly of FIGS. 1-6 and a pedestal for coupling the midsection assembly to a transom of a marine vessel.

Turning to FIG. 4, one example of an outboard motor 10 according to the present disclosure will now be described. The outboard motor 10 comprises an internal combustion engine 32. The outboard motor 10 further comprises an adapter plate 34 having an upper end 36 that is coupled to and supports the engine 32. Referring also to FIG. 7, the upper end 36 of the adapter plate 34 has a shape that matches that of a bottom surface of a cylinder block 38 (FIG. 4) of the engine 32. The upper end 36 of the adapter plate 34 can be coupled to the bottom surface of the cylinder block 38 by any manner known to those having ordinary skill in the art, such as for example by inserting bolts through a number of holes 40 shown around the perimeter of the upper end 36 of the adapter plate 34 and into the cylinder block 38. A gasket may also be provided to provide a fluid-tight seal at this interface. A lower end of the adapter plate 34 comprises a cylindrical neck 42.

Still referring to FIGS. 4 and 7, the outboard motor 10 further comprises a driveshaft housing 18 situated below the adapter plate 34 and having an integral oil sump 44 collecting oil that drains from the engine 32 and through the adapter plate neck 42. This oil was used to lubricate and cool portions of the engine 32, which in one example may be a 4-stroke engine, such as moving parts in the cylinder block 38. Due to the fluid-tight connection between the bottom surface of the cylinder block 38 and the upper end 36 of the adapter plate 34, oil that has been provided to the engine 32 will drain down into the adapter plate 34 and along a sloped surface 46 provided therein, to a passageway 48 that leads to the adapter plate neck 42. From there, the oil will drain into and collect in the oil sump 44, which has a cylindrical upper end 50 into which the neck 42 of the adapter plate 34 fits. A first bearing 52 couples the adapter plate neck 42 to the upper end 50 of the oil sump 44, as will be described further herein below.

As shown in FIG. 4, the outboard motor 10 further comprises a driveshaft 80 having an upper end 82 coupled to a crankshaft 84 of the engine 32 in torque-transmitting relationship, for example via a splined connection. The driveshaft 80 extends along a generally vertical driveshaft axis 86 through the adapter plate neck 42, the first bearing 52, and the oil sump 44 toward a lower end 88. Specifically, referring to FIG. 5, the driveshaft 80 extends along the driveshaft axis 86 through a central passageway 90 provided in the adapter plate 34 and held to and supported by the inner surface of the neck 42 by spokes 91 (FIG. 7). The driveshaft 80 also extends through a central passageway 92 that extends from a bottom 93 of the oil sump 44. The passageway 92 may extend partially into the passageway 90 for stability. Together, the passageways 90, 92 prevent the driveshaft 80 from coming into direct contact with the oil that collects in the oil sump 44.

Referring back to FIG. 4, the outboard motor 10 further comprises a lower unit 24 coupled to the driveshaft housing 18 beneath an anti-ventilation plate 94. The lower unit 24 includes a gearcase 26 connected to the driveshaft housing 18 for example by way of a series of bolts. A propeller shaft 96 is partially housed within the gearcase 26 of the lower unit 24 and has a first end 98 coupled to the lower end 88 of the driveshaft 80 in torque-transmitting relationship. This coupling is not shown herein, but could be made using a beveled gear set and a dog clutch as known in the art. The propeller shaft 96 has a second end 100, which is coupled to a propeller 28, such as by way of a splined connection with a propeller hub 102.

Figure 5:
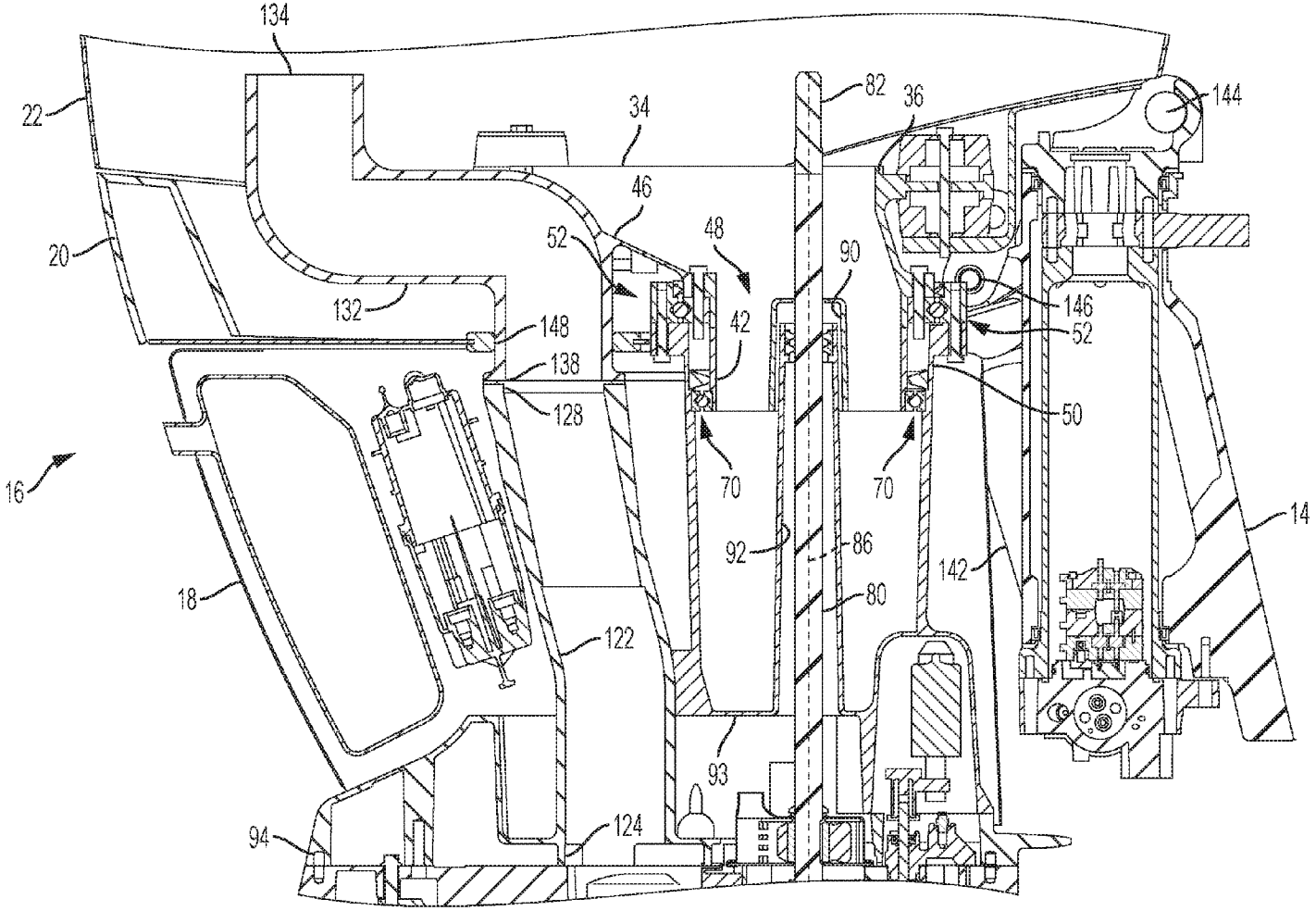
FIG. 5 illustrates a detailed cross-sectional view of a midsection assembly of the outboard motor of FIG. 4.
Figure 6:
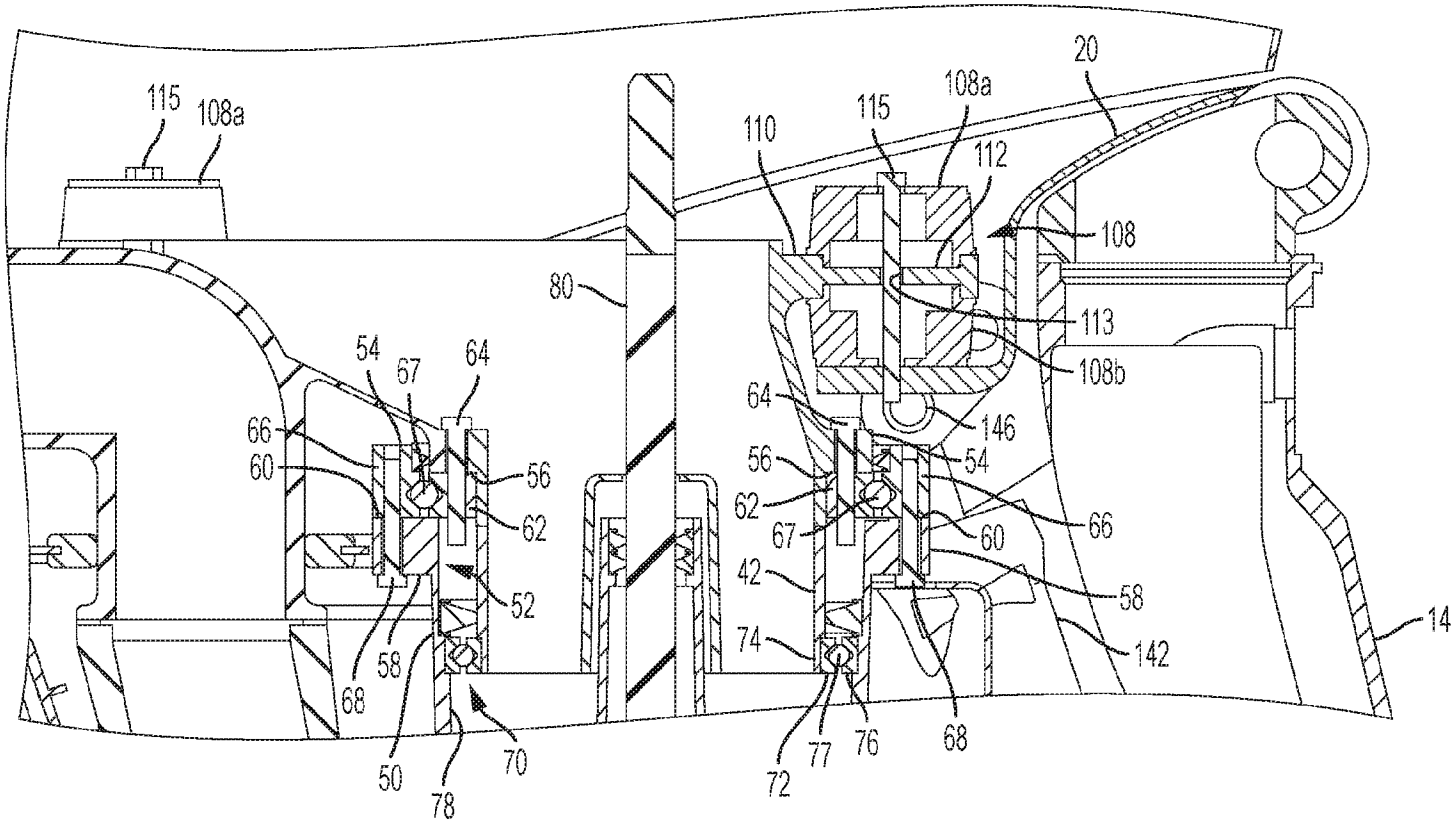
FIG. 6 illustrates a detailed cross-sectional view of a bearing used in the midsection assembly of the outboard motor of FIGS. 4 and 5.

Turning now to FIGS. 5-7, a first bearing 52 couples the adapter plate neck 42 to the upper end 50 of the oil sump 44 such that the driveshaft housing 18 (of which the oil sump 44 is an integral pan) is suspended from and rotatable with respect to the adapter plate 34. More specifically, as shown in FIG. 6, the adapter plate neck 42 has a circumferential flange 54 having a downwardly facing surface 56. The upper end 50 of the oil sump 44 has a circumferential lip 58 having an upwardly facing surface 60. An inner race 62 of the first bearing 52 is connected to the downwardly facing surface 56 of the flange 54, such as by plurality of bolts 64 extending around the circumference of and through the inner race 62 of the first bearing 52. An outer race 66 of the first bearing 52 is connected to the upwardly facing surface 60 of the lip 58, such as by a plurality of bolts 68 provided around the circumference of and through the outer race 66 of the first bearing 52. The rolling elements 67 provided in the first bearing 52 allow the outer race 66 and oil sump 44 to rotate with respect to the relatively stationary inner race 62 and adapter plate neck 42. The first bearing 52 may be custom-made to facilitate a minimally-sized mounting envelope, while still providing the necessary strength of the joint. The outboard motor 10 also has a second bearing 70. The second bearing 70 has an inner race 72 connected to an outer surface of a lower end 74 of the adapter plate neck 42, and an outer race 76 connected to an inner surface 78 of the oil sump 44. Rolling elements 77 allow the outer race 76 and oil sump 44 to rotate with respect to the relatively stationary inner race 72 and adapter plate neck 42. The second bearing 70 may be an off-the-shelf bearing, or may also be of custom construction.

Many different types of bearings could be used as the first and second bearings 52, 70. However, in one example, the bearings 52, 70 are angular contact ball bearings. Tapered roller bearings, thrust bearings, or other types of bearings could be used, and the type of bearing is not limiting on the scope of the present disclosure. The present inventors have realized, however, that utilizing both first and second bearings 52, 70 provides the required strength of the connection between the adapter plate 34 and oil sump 44, not only such that the adapter plate 34 is able to hold the driveshaft housing 18 and lower unit 24 suspended therefrom, but also such that the adapter plate 34 is able to withstand the loads (provided in a multitude of different directions) created by the thrust of the outboard motor 10 as it propels the marine vessel. It should be understood that depending on the type of bearings used, and on the weight of the outboard motor's components, fewer or more bearings than shown herein could be used. For example, providing the second bearing 70 allows the first bearing 52 to be made smaller than it might otherwise need to be were the first bearing 52 the only bearing provided.

Although the lower end 74 of the adapter plate neck 42 is shown as being located coaxially within the oil sump 44 by insertion of the former into the upper end 50 of the latter, the upper end 50 of the oil sump 44 could instead have a smaller diameter than the adapter plate neck 42 and could be located coaxially therein. The connection of the inner and outer races of the first and second bearings 52, 70 to the oil sump 44 and adapter plate neck 42 would in this instance be reversed.

Turning now to FIGS. 6-9, and also referring back to FIGS. 1-3, the outboard motor 10 further comprises a supporting cradle 20 that couples the adapter plate 34 to a pedestal 14. As described above, the pedestal 14 is configured to be coupled to a transom 12 of a marine vessel, such as by bolting. The adapter plate 34 is coupled to the cradle 20 by way of a plurality of mounts 108. Although three mounts 108 are shown herein (see FIG. 7), it should be understood that fewer or more mounts could be provided, depending on the configuration of the adapter plate 34. Referring to FIGS. 6 and 7, the adapter plate 34 is connected to the mounts 108 by three arms 110 that extend radially outwardly from the upper end 36 of the adapter plate 34. Each of the arms 110 has a mounting area 112, and the mounting areas 112 each have a hole 113 for the passage of a connector 115 therethrough. An upper half 108*a* of the mount 108 sits on top of the mounting area 112. The connectors 115 extend through holes in the upper halves 108*a* of the mounts 108, then through the holes 113 in the mounting areas 112 of the adapter plate 34, then into lower halves 108*b* of the mounts 108, and then into the cradle 20. The mounts 108 may be vibration isolation mounts with an elastomer provided therein to prevent visible cowl shake of the outboard motor 10 and to minimize transfer of vibration from the outboard motor 10 to the marine vessel via the transom 12.

Figure 9:
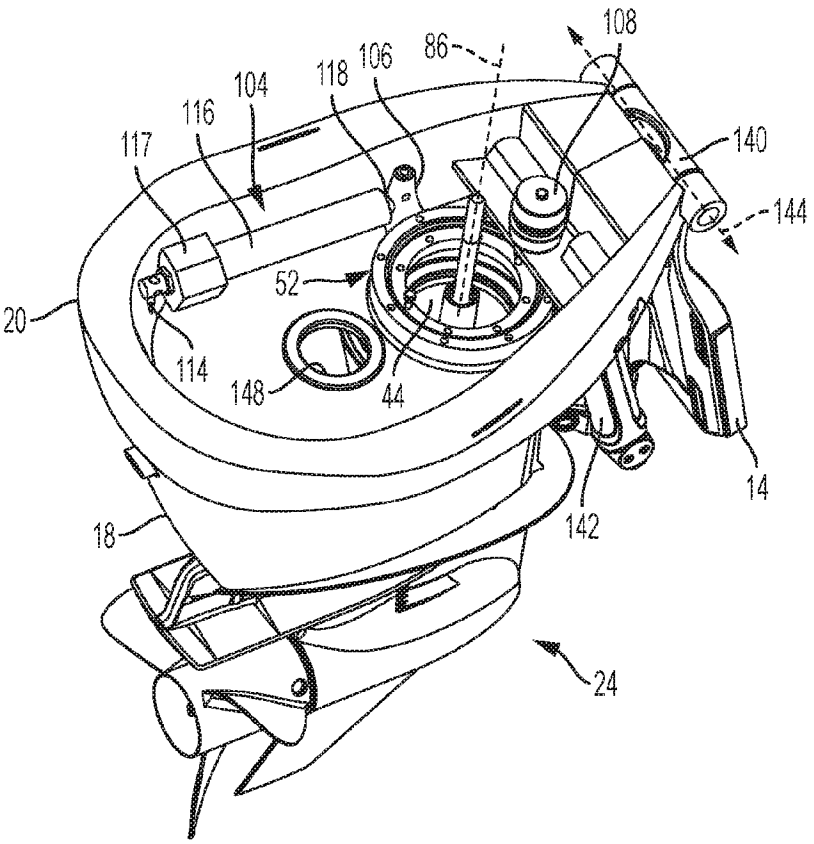
FIG. 9 illustrates another example of a steering actuator coupled to the midsection assembly of the present disclosure.
Figure 8:
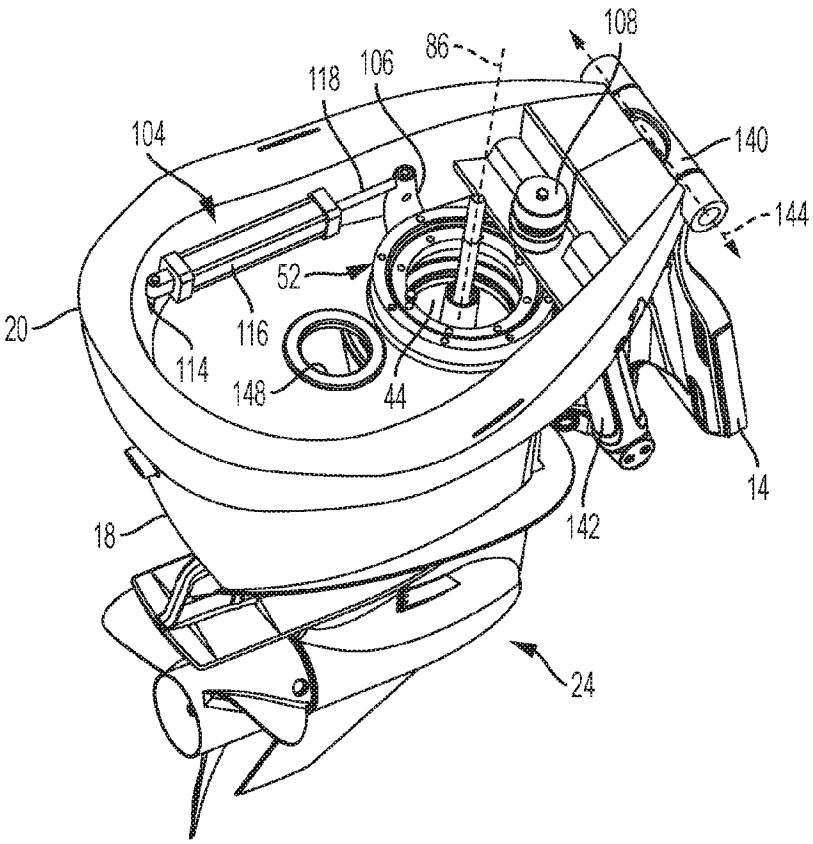
FIG. 8 illustrates one example of a steering actuator coupled to the midsection assembly of the present disclosure.

Thus, the adapter plate 34 is coupled to the cradle 20 by way of mounts 108. The cradle 20 is in turn coupled to the pedestal 14 by way of a tilt pivot head 140. Additionally, hydraulic tilt actuators 142 (one of which is shown in FIGS. 6, 8, and 9, but two of which may be provided on either side of the pedestal 14) can be used to tilt the outboard motor 10 around a generally horizontal tilt/trim axis 144 running through the tilt pivot head 140, as known to those having ordinary skill in the art, and one example of which is described in U.S. Pat. No. 6,183,321, incorporated by reference above. This can be done by way of connections, made at connector 146 (one of which is shown in FIGS. 5 and 6, but another of which can be provided on the other side of the assembly) between piston rods extending from upper ends of the hydraulic tilt actuators 142 and the cradle 20. As the cradle 20 is tilted by the actuators 142, the adapter plate 34 is tilted due to its connection to the cradle 20 via the mounts 108. The powerhead 22, coupled atop the adapter plate 34, is thus also tilted. The driveshaft housing 18 and lower unit 24, coupled below the adapter plate 34, are therefore also tilted.

Referring to FIGS. 7-9, the outboard motor 10 further comprises a steering actuator 104 coupled to and rotating the oil sump 44 and thereby rotating the driveshaft housing 18 around the driveshaft axis 86 with respect to the adapter plate 34. This is done, for example, by way of a steering arm 106 that extends from the oil sump 44, and more specifically from the upper end 50 of the oil sump 44, that is coupled to the steering actuator 104. The steering arm 106 may be integral with the oil sump 44, or may be a separate component that is coupled to the oil sump 44. In the example shown, the steering actuator 104 is mounted to the cradle 20, such as by way of a pin 114 that is provided extending from an inner surface of the cradle 20. The pin 114 is connected to a stationary component 116 of the steering actuator 104, while the steering arm 106 is connected to a moveable component 118 of the steering actuator 104. In the example of FIG. 8, the steering actuator 104 comprises a hydraulic cylinder and piston/rod combination, wherein the stationary component 116 is the cylinder and the moveable component 118 is the piston rod. The steering actuator 104 may be an electro-hydraulic actuator, such that electric steering signals (such as from a helm steering device) sent to the steering actuator 104 cause a volume of hydraulic fluid to be pumped into or out of the cylinder end of the steering actuator 104 so as to move the piston and rod, and therefore the steering arm 106.

In FIG. 9, the steering actuator 104 is an electric-linear actuator. An electric signal (such as from a helm steering device) sent to the steering actuator 104 causes a motor in a housing 117 of the stationary component 116 to move a rod at the moveable component 118 and to thereby move the steering arm 106. In other examples, actuation of the steering arm 106 can be achieved by a cable connection to a traditional steering actuator located on the pedestal 14. Alternative steering actuators could include an electromechanical device powered by an electric motor that is responsive to steer-by-wire commands from the marine vessel helm.

In the examples shown, as the moveable component 118 is retracted into the stationary component 116, this causes the steering arm 106 to move in an aft-ward direction, which rotates the oil sump 44 in a counter-clockwise direction as viewed from the rear. As the moveable component 118 is extended from the stationary component 116, this causes the steering arm 106 to move in a fore-ward direction, which rotates the oil sump 44 in a clockwise direction as viewed from the rear.

Rotation of the oil sump 44 causes the entire driveshaft housing 18 to rotate. Referring to FIG. 7, this is because the oil sump 44 is an integral portion of the driveshaft housing 18, such as by way of a connection of the oil sump 44 to the anti-ventilation plate 94 and the anti-ventilation plate's connection to chaps (driveshaft housing cover) 120. The oil sump 44 (and thus the driveshaft housing 18) rotate around the neck 42 of the adapter plate 34 via the first and second bearings 52, 70. Therefore, the connected lower unit 24 rotates with the driveshaft housing 18 around the driveshaft axis 86 such that a direction of thrust produced by the propeller 28 changes as the lower unit 24 rotates. This causes the marine vessel to be steered by rotation of the driveshaft housing 18 and lower unit 24, rather than rotation of the entire outboard motor 10, as in the prior art. For example, as the oil sump 44 rotates in a counterclockwise direction due to retraction of the moveable component 118 within the stationary component 116, this causes the lower unit 24 to rotate in a counter-clockwise direction and a thrust in the forward direction will thus propel the marine vessel to starboard.

Now turning to FIGS. 4, 5, and 7, the exhaust system of the outboard motor 10 will be described. The outboard motor 10 comprises a lower exhaust pipe 122 that extends through the driveshaft housing 18 and rotates with the driveshaft housing 18. This is because the lower exhaust pipe 122 and the oil sump 44 are coupled to one another via the anti-ventilation plate 94. In one example, the lower exhaust pipe 122 is also integral with the anti-ventilation plate 94 such that the lower exhaust pipe 122, anti-ventilation plate 94, and oil sump 44 comprise one single integral component that is surrounded by the chaps 120 to form the driveshaft housing 18. In another example, the lower exhaust pipe 122 is a separate component coupled to the anti-ventilation plate 94. A lower end 124 of the lower exhaust pipe 122 is in fluid communication with a passageway 126 that extends through the lower unit 24 (see FIG. 4) and eventually expels exhaust gases out the hub 102 of the propeller 28.

An upper end 128 of the lower exhaust pipe 122 has a kidney-shaped fitting 130 (FIG. 7). The purpose of the kidney shape of this fitting will be described further herein below. An upper exhaust pipe 132 is also provided in the outboard motor 10. The upper exhaust pipe 132 has an upper end 134 coupled to an exhaust manifold 136 of the engine 32. The upper exhaust pipe 132 has a lower end 138 that is coupled to the upper end 128 of the lower exhaust pipe 122. The lower end 138 of the upper exhaust pipe 132 fits into the kidney-shaped fitting 130 at the upper end 128 of the lower exhaust pipe 122. The kidney-shaped fitting 130 slides with respect to the lower end 138 of the upper exhaust pipe 132 as the driveshaft housing 18 rotates with respect to the adapter plate 34. In one example, the upper exhaust pipe 132 is integral with the adapter plate 34 (see FIG. 7). In another example, the upper exhaust pipe 132 is formed as a separate part from the adapter plate 34, such as for example using a lost foam casting process. The lower end 138 of the upper exhaust pipe 132 can fit through a hole 148 (see also FIGS. 8 and 9) provided in an upper surface of the chaps 120 and/or a lower surface of the cradle 20. Below this hole 148, the lower end 138 of the upper exhaust pipe 132 can be provided with a kidney-shaped flange 150, which serves to cover over open areas of the kidney-shaped fitting 130 as the kidney-shaped fitting 130 on the lower exhaust pipe 122 slides with respect to the lower end 138 of the upper exhaust pipe 132.

The routing of the lower exhaust pipe 122 leaves space available within the driveshaft housing 18 for a fuel supply module 152 and idle relief muffler 154 to be provided. See FIG. 4. These parts rotate with the driveshaft housing 18, and thus a careful connection of the fuel supply module to the engine 32 should be made.

Referring to all of the FIG. 5, the present disclosure is also of a midsection assembly 16 for an outboard motor. The midsection assembly 16 includes an adapter plate 34 having an upper end 36 configured to support an internal combustion engine 32 and a lower end formed as a cylindrical neck 42. The midsection assembly 16 also includes a driveshaft housing 18 situated below the adapter plate 34 and having an integral oil sump 44 collecting oil that drains from the engine 32 and through the adapter plate neck 42, the oil sump 44 having a cylindrical upper end 50. The midsection assembly 16 includes a steering arm 106 that extends from the upper end 50 of the oil sump 44 and a first bearing 52 coupling the adapter plate neck 42 to the upper end 50 of the oil sump 44 such that the driveshaft housing 18 is suspended from and rotatable with respect to the adapter plate 34. A generally vertical driveshaft axis 86 is defined through the adapter plate neck 42, the first bearing 52, and the oil sump 44 The steering arm 106 is configured to be coupled to a steering actuator 104 such that the oil sump 44 and the driveshaft housing 18 can be actuated to rotate around the driveshaft axis 86 with respect to the adapter plate 34 so as to vary a direction of thrust produced by the outboard motor 10. A supporting cradle 20 is configured to couple the adapter plate 34 to a pedestal 14, and the pedestal 14 is configured to be coupled to a transom 12 of a marine vessel.

As mentioned above, cradle 20, adapter plate 34, and powerhead 22 may remain stationary, with their centerlines parallel to the centerline 30 of the marine vessel, while the driveshaft housing 18 and lower unit 24 rotate with respect to these parts. In other examples, as also mentioned above, the cradle 20, adapter plate 34, and powerhead 22 may rotate to some extent, with additional relative rotation of the driveshaft housing 18 and lower unit 24. Therefore, the pedestal 14 may be provided with or without steering capabilities, and its own steering actuator. If no steering actuator is provided on the pedestal 14, then steering is accomplished solely via the steering actuator 104 and its coupling to the steering arm 106 and oil sump 44. If a steering actuator is provided on the pedestal 14, such that the entire outboard motor 10 is able to be rotated around a vertical steering axis, additional steering could also be provided by rotating the driveshaft housing 18 and lower unit 24 with respect to the adapter plate 34, cradle 20, and powerhead 22 using the steering actuator 104. In the second instance, the angle to which the entire outboard motor 10 could be steered may be limited to prevent collision of the outboard motor with another outboard motor, and additional steering for tight turns could be provided by the relatively rotatable system described herein. Thus, by providing a system that steers the lower half of the outboard motor 10 around the driveshaft axis 86, separate from a traditional transom-mounted steering system, interference between multiple outboard motor installations can be reduced or eliminated.

Additionally, the present system increases the maximum angle available for an outboard motor's thrust, which might not otherwise be allowed by a larger outboard motor that rotates around a vertical steering axis that is defined closer to the transom 12 of the marine vessel, while at the same time reducing steering loads. Reduction of steering loads is achieved because the steering axis (co-located with the driveshaft axis 86) is moved closer to the propeller 28, and thus the moment arm between the center of pressure on the lower unit 24 and the steering axis is made shorter.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and assemblies described herein may be used alone or in combination with other systems and assemblies. It is to be expected that various equivalents, alternatives and modifications are possible within the scope of the appended claims.

What is claimed is:

1. An outboard motor comprising:

an internal combustion engine;

an adapter plate having an upper end that is coupled to and supports the engine and a lower end formed as a cylindrical neck;

a driveshaft housing situated below the adapter plate and having an integral oil sump collecting oil that drains from the engine and through the adapter plate neck, the oil sump having a cylindrical upper end;

a first bearing coupling the adapter plate neck to the upper end of the oil sump such that the driveshaft housing is suspended from and rotatable with respect to the adapter plate;

a driveshaft having an upper end coupled to a crankshaft of the engine, and extending along a driveshaft axis through the adapter plate neck, the first bearing, and the oil sump toward a lower end; and a steering actuator coupled to and configured to rotate the oil sump so as to rotate the driveshaft housing around the driveshaft axis with respect to the adapter plate and thereby vary a direction of thrust produced by the outboard motor.

2. The outboard motor of claim 1, wherein a lower end of the adapter plate neck is located coaxially within the oil sump.

3. The outboard motor of claim 2, wherein an upper end of the adapter plate neck has a circumferential flange with a downwardly facing surface, and the upper end of the oil sump has a circumferential lip with an upwardly facing surface, and wherein an inner race of the first bearing is connected to the flange and an outer race of the first bearing is connected to the lip.

4. The outboard motor of claim 2, further comprising a second bearing having an inner race connected to the lower end of the adapter plate neck and an outer race connected to an inner surface of the oil sump.

5. The outboard motor of claim 1, further comprising:

a lower exhaust pipe that extends through the driveshaft housing and rotates with the driveshaft housing; and an upper exhaust pipe having an upper end coupled to an exhaust manifold of the engine and a lower end coupled to an upper end of the lower exhaust pipe;

wherein the upper end of the lower exhaust pipe has a kidney-shaped fitting into which the lower end of the upper exhaust pipe fits, such that the kidney-shaped fitting slides with respect to the lower end of the upper exhaust pipe as the driveshaft housing rotates with respect to the adapter plate.

6. The outboard motor of claim 5, wherein the upper exhaust pipe is integral with the adapter plate.

7. The outboard motor of claim 5, further comprising an anti-ventilation plate formed at a lower end of the driveshaft housing, wherein the oil sump and the lower exhaust pipe are coupled to one another via the anti-ventilation plate.

8. The outboard motor of claim 7, further comprising:

a lower unit coupled to the driveshaft housing beneath the anti-ventilation plate; and a propeller shaft housed within the lower unit and having a first end coupled to the lower end of the driveshaft and a second end coupled to a propeller;

wherein the lower unit rotates with the driveshaft housing around the driveshaft axis such that a direction of thrust produced by the propeller changes as the lower unit rotates.

9. The outboard motor of claim 1, further comprising a steering arm that extends from the oil sump and is coupled to the steering actuator.

10. The outboard motor of claim 1, further comprising a supporting cradle that couples the adapter plate to a pedestal;

wherein the pedestal is configured to be coupled to a transom of a marine vessel; and wherein the steering actuator is mounted to the cradle.

11. The outboard motor of claim 1, wherein the first bearing is an angular contact ball bearing.

12. A midsection assembly for an outboard motor, the midsection assembly comprising:

an adapter plate having an upper end configured to support an internal combustion engine and a lower end formed as a cylindrical neck;

a driveshaft housing situated below the adapter plate and having an integral oil sump collecting oil that drains from the engine and through the adapter plate neck, the oil sump having a cylindrical upper end;

a steering arm that extends from the upper end of the oil sump; and a first bearing coupling the adapter plate neck to the upper end of the oil sump such that the driveshaft housing is suspended from and rotatable with respect to the adapter plate;

wherein a generally vertical driveshaft axis is defined through the adapter plate neck, the first bearing, and the oil sump; and wherein the steering arm is configured to be coupled to a steering actuator such that the oil sump and the driveshaft housing can be actuated to rotate around the driveshaft axis with respect to the adapter plate so as to vary a direction of thrust produced by the outboard motor.

13. The midsection assembly of claim 12, wherein a lower end of the adapter plate neck is located coaxially within the oil sump.

14. The midsection assembly of claim 13, wherein an upper end of the adapter plate neck has a circumferential flange with a downwardly facing surface, and the upper end of the oil sump has a circumferential lip with an upwardly facing surface, and wherein an inner race of the first bearing is connected to the flange and an outer race of the first bearing is connected to the lip.

15. The midsection assembly of claim 13, further comprising a second bearing having an inner race connected to the lower end of the adapter plate neck and an outer race connected to an inner surface of the oil sump.

16. The midsection assembly of claim 12, further comprising:

a lower exhaust pipe that extends through the driveshaft housing and rotates with the driveshaft housing; and an upper exhaust pipe having an upper end configured to be coupled to an exhaust manifold of the engine and a lower end coupled to an upper end of the lower exhaust pipe;

wherein the upper end of the lower exhaust pipe has a kidney-shaped fitting into which the lower end of the upper exhaust pipe fits, such that the kidney-shaped fitting slides with respect to the lower end of the upper exhaust pipe as the driveshaft housing rotates with respect to the adapter plate.

17. The midsection assembly of claim 16, wherein the upper exhaust pipe is integral with the adapter plate.

18. The midsection assembly of claim 16, further comprising an anti-ventilation plate formed at a lower end of the driveshaft housing, wherein the oil sump and the lower exhaust pipe are coupled to one another via the anti-ventilation plate.

19. The midsection assembly of claim 12, further comprising a supporting cradle configured to couple the adapter plate to a pedestal, wherein the pedestal is configured to be coupled to a transom of a marine vessel.

20. The midsection assembly of claim 12, wherein the first bearing is an angular contact ball bearing.

* * * * *